US006471802B1

(12) United States Patent
Williamson

(10) Patent No.: US 6,471,802 B1
(45) Date of Patent: Oct. 29, 2002

(54) LABELING APPARATUS AND METHOD

(75) Inventor: Jimmy D. Williamson, Turlock, CA (US)

(73) Assignee: Gerro Plast GmbH, Duesseldorf (DE)

( * ) Notice: Subject to any disclaimer, the term of this patent is extended or adjusted under 35 U.S.C. 154(b) by 0 days.

(21) Appl. No.: 09/422,683

(22) Filed: Oct. 21, 1999

Related U.S. Application Data

(60) Provisional application No. 60/111,230, filed on Dec. 7, 1998, and provisional application No. 60/111,311, filed on Dec. 7, 1998.

(51) Int. Cl.[7] ..... B65C 9/18; B65C 9/20; B65C 9/42

(52) U.S. Cl. ..... 156/64; 156/250; 156/256; 156/351; 156/534; 156/556; 156/566; 156/567; 156/DIG. 33; 156/DIG. 45

(58) Field of Search ..... 156/533, 534, 156/538, 539, 556, 566, 567, 568, DIG. 24, DIG. 28, DIG. 33, DIG. 34, DIG. 35, DIG. 36, 353, 64, 264, 269, 250, 256, 351

(56) References Cited

U.S. PATENT DOCUMENTS

| | | | |
|---|---|---|---|
| 3,027,870 | A | 5/1962 | Schirmer |
| 3,048,146 | A | 8/1962 | Coppola |
| 3,088,859 | A | 5/1963 | Smith |
| 3,295,491 | A | 1/1967 | Cassarno |
| 3,322,095 | A | 5/1967 | Gelbjerg-Hansen et al. |
| 3,422,793 | A | 1/1969 | Lachmann |
| 3,565,724 | A | 2/1971 | Yamagucki |
| 3,635,194 | A | 1/1972 | Prior |
| 3,779,829 | A | 12/1973 | Wolff |
| 3,963,557 | A | 6/1976 | Patterson |
| 3,988,194 | A | 10/1976 | Babcock et al. |
| 4,188,843 | A | 2/1980 | Dickey |
| 4,210,481 | A | 7/1980 | Wolff et al. |
| 4,269,874 | A | 5/1981 | Pryor et al. |
| 4,332,635 | A | 6/1982 | Holbrook et al. |
| 4,338,155 | A | 7/1982 | Buchele |
| 4,354,887 | A | 10/1982 | Total |

(List continued on next page.)

FOREIGN PATENT DOCUMENTS

| | | |
|---|---|---|
| DE | 21 24 317 A | 11/1972 |
| DE | 195 44 763 A1 | 6/1997 |
| EP | 0 220 707 A | 5/1987 |
| FR | 1446880 | 6/1966 |
| FR | 2 427 987 A | 1/1980 |
| WO | WO94/15842 | 7/1994 |
| WO | WO97 16370 A | 5/1997 |
| WO | WO98/17537 | 4/1998 |
| WO | WO98/19916 | 5/1998 |
| WO | WO98/36974 | 8/1998 |

OTHER PUBLICATIONS

Larsen, Walter C., A study in machine development, *Technical & Engineering*, Mar. 1960, pp. 201–207.

*Primary Examiner*—Richard Crispino
*Assistant Examiner*—Sue A. Purvis
(74) *Attorney, Agent, or Firm*—Emch, Schaffer, Schaub & Porcello, Co., L.P.A.

(57) ABSTRACT

Labeling apparatus and method cuts labels from a web of label material after adhesive is applied to the web of material. Under one embodiment heated knives are carried on a vacuum drum which cooperates with a roller functioning as an anvil to cut the web into labels of the appropriate length. A sensor reads a mark of the indicia side of the web and controls movement of the web to assure proper registration. Under a second embodiment, a rotatable drum having a plurality of vacuum plates cooperates with a die cutting roller to cut labels of the desired shape. The cut labels are retained on the vacuum applicator plates which then are extended radially as they rotate to a position to apply the label to a container.

32 Claims, 9 Drawing Sheets

U.S. PATENT DOCUMENTS 4,369,214 A 1/1983 Pfulb et al.
4,373,986 A * 2/1983 Cone ..... 156/552
4,416,714 A 11/1983 Hoffmann
4,544,431 A 10/1985 King
4,589,943 A 5/1986 Kimball et al.
4,595,449 A 6/1986 Nowicki
4,629,528 A 12/1986 Tanaka et al.
4,632,721 A 12/1986 Hoffmann et al.
4,642,150 A 2/1987 Stemmler
4,662,528 A 5/1987 Slat
4,671,843 A 6/1987 Olsen
4,687,535 A 8/1987 Voltmer
4,708,630 A 11/1987 Hammond
4,761,200 A 8/1988 Szeremeta
4,767,487 A * 8/1988 Tomsovic, Jr. ..... 156/256
4,798,648 A * 1/1989 Freeman ..... 156/542
4,844,760 A 7/1989 Dickey
4,904,324 A 2/1990 Heider
4,978,415 A * 12/1990 Jones ..... 156/517
5,024,717 A 6/1991 Winter
5,032,344 A 7/1991 Kaminski
5,079,057 A 1/1992 Heider
5,116,452 A 5/1992 Eder
5,160,570 A 11/1992 Dickey
5,254,302 A 10/1993 Yamanaka
5,259,910 A 11/1993 Biagiotti
5,266,149 A 11/1993 Collette et al.
5,356,508 A 10/1994 Watanabe
5,405,667 A 4/1995 Heider
5,431,763 A 7/1995 Bradshaw
5,486,254 A * 1/1996 Gallgher et al. ..... 156/229
5,618,347 A 4/1997 Clare et al.
5,711,831 A * 1/1998 Taylor ..... 156/64
5,741,381 A * 4/1998 Dolence et al. ..... 156/64
6,167,935 B1 * 2/2001 Heider et al. ..... 156/567

* cited by examiner

LABELING APPARATUS AND METHOD

CROSS-REFERENCE TO RELATED APPLICATIONS

This application claims the benefit of U.S. Provisional Application Nos.: No. 60/111,230 filing date Dec. 7, 1998 No. 60/111,311 filing date Dec. 7, 1998.

This application claims the benefit of the following Provisional Patent Applications: Serial No. 60/111,230 filed Dec. 7, 1998 and 60/111,311 filed Dec. 7, 1998.

BACKGROUND OF THE INVENTION

Labeling machines are used to apply labels to all types of containers, both cylindrical containers and non-cylindrical containers, such as regular and irregular shaped polygons. One type of conventional label is a self-stick label, also called a pressure-sensitive label, which is carried by a backing strip or carrier web. Self-stick labels are expensive and create a large amount of waste. Self-stick labels typically used with high-density polyethylene (HDPE) containers, such as milk jugs and juice bottles, are commonly a paper/propropylene/adhesive laminate. In applying the conventional self-stick or pressure sensitive labels to containers, the carrier web with spaced apart labels affixed thereto is unwound from a supply roll and pulled over a bar or blade causing each label to separate from the carrier web, which carrier web is then disposed of. Means are then provided to transfer each label to a container.

The above described method has a number of important limitations and disadvantages. First, the carrier web required for this process adds significant cost to the label being applied. Second, the process of die-cutting on a supporting web limits the type of label materials that can be utilized. Third, the label must be peeled off the carrier web at point of application. This creates limitations in line speed potential, further limits the type of label materials which can be used, such as lightweight stock. In addition it greatly reduces the accuracy of application to the container. Another type of commonly used label is cut from continuous label material wound onto a roll. Labels made from continuous label material are more economical than self-stick labels and are often made from thin, stretchable film. To reduce the cost, the film keeps being made thinner. The stretchiness of the film can make it difficult to ensure that the labels are properly cut.

Conventional labeling machines remove the continuous label material from the roll and feed the label material to a cutting system. The continuous label material is then cut into labels which are transferred onto the circumferential surface of a vacuum drum where they are held in place by vacuum. As the drum rotates the labels pass a glue roller which applies adhesive to the back surface of the label, which is facing outwardly as supported on the drum. The label, with the adhesive applied thereto, is released from the drum as it comes into contact with and is applied to a container.

U.S. patent application Ser. No. 09/024,886 filed Feb. 17, 1998 and Ser. No. 09/301,955 filed Apr. 29, 1999 of which I am a co-inventor, disclose an adhesive station and labeling machine for applying a pressure sensitive label to a container wherein adhesive is sprayed on one side of the label material after the label material has been severed from a web of label stock. The method and apparatus disclosed in those previous applications, incorporated herein by reference, eliminate the need for having a backing strip which is customarily used for carrying a pressure-sensitive label.

SUMMARY OF THE INVENTION

Under the present invention, a web label material is fed from a roll or other source of label stock to an adhesive applicator station which applies adhesive to the side intended to be adhered to the container, namely, the side opposite the printing. Following the application of adhesive, the web passes through a cutting station where the individual labels are cut while being supported by vacuum on a rotatable vacuum drum. Although it is possible to have the entire surface of the label intended to face the container covered with adhesive, for many applications it is preferred that the adhesive cover only an area of ½ to 1" adjacent each end. By cutting the web of label material after the adhesive has been applied thereto and cutting through the adhesive as well as the web, it is assured that each label will have adhesive completely to each end thereof. This assures bonding of the labels to the containers completely to each end and avoids the problem of "flagging" of label ends having inconsistent adhesive application.

The web of label material can be any one of a variety of materials including but not limited to foam polystyrene, other foam polymers, polypropylene film, other polymer film and paper. Under one embodiment, cutters or knives are mounted on the rotating vacuum drum and a second rotating drum acts as an anvil cooperable with the vacuum drum to cut the web into labels. Following cutting, each newly cut label, supported on the rotating vacuum drum, successively engages a container while its adhesive is in condition for adhering to the container.

A second embodiment, also uses any suitable label material in roll form, including lightweight label stock. The web of label material is fed to an adhesive application station and a rotary die cutter.

As the continuous web of label material with hot melt adhesive applied thereto is fed into the applicating system, it passes a rotary die cutter adjacent and in contact with a rotary backup and transfer drum containing vacuum applicator plates. Each label is supported on one of a series of vacuum applicator plates which are mounted on a rotatable back-up drum. The vacuum applicator plates are mounted for rotation with the drum and are moveable radially from a retracted position when receiving the web from the adhesive application station and when at the cutting station to a radially outwardly extended position, at which extended position each vacuum applicator plate joins the label to a container. Under the second embodiment, the cutters or knives are mounted on a second rotatable drum positioned to cut a label from that portion of the web which is then aligned with the vacuum applicator plate. The newly cut labels are then successively moved to a container while being retained on the vacuum applicator plate. As the vacuum applicator plates successively move from the cutting station to the application station, they are moved radially outwardly to the extended position.

DESCRIPTION OF INVENTION

Figure 1:
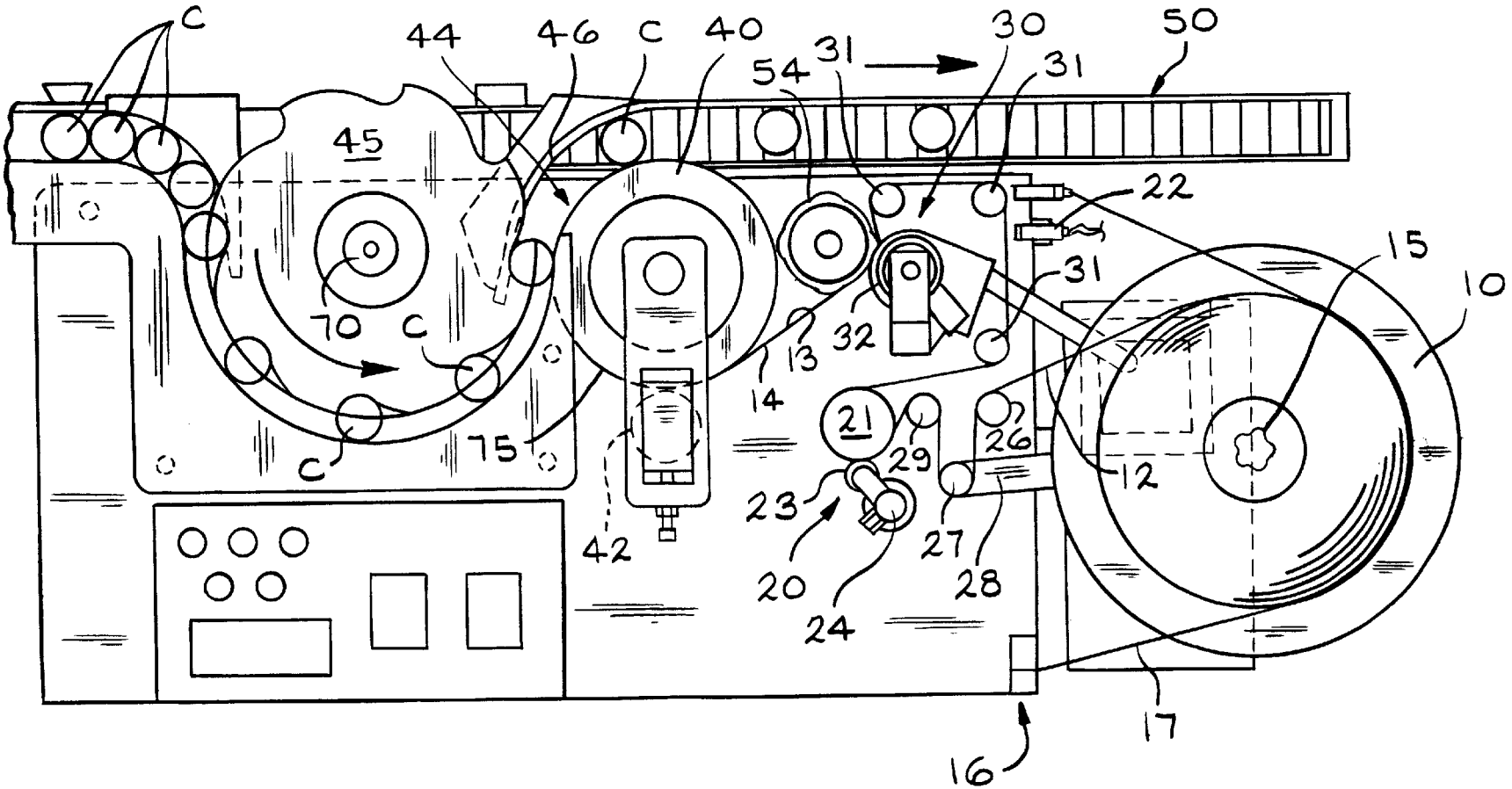
FIG. 1 is a schematic top plan view of one embodiment of the present invention.
Figure 2:
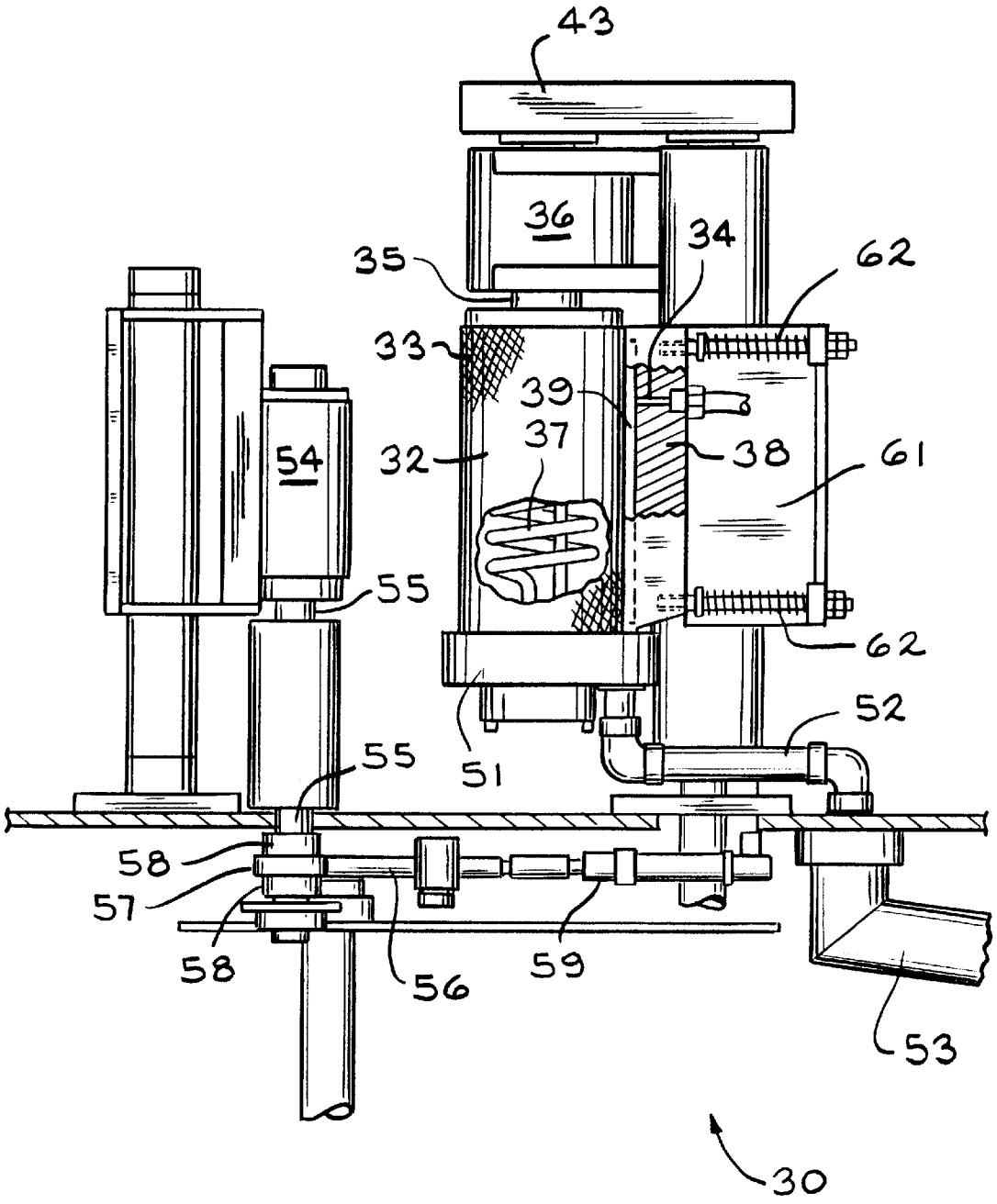
FIG. 2 is an enlarged elevational view of the glue applicator portion of the labeling apparatus of FIG. 1.

Referring to FIGS. 1–7, there is shown one embodiment of labeling apparatus according to the present invention. The apparatus includes a supply roll 10 containing a web 12 of label stock having a first side 13 with printed indicia including a mark M and a second side 14 which is intended to receive adhesive for adhering a label 25 to a container.

Figure 6:
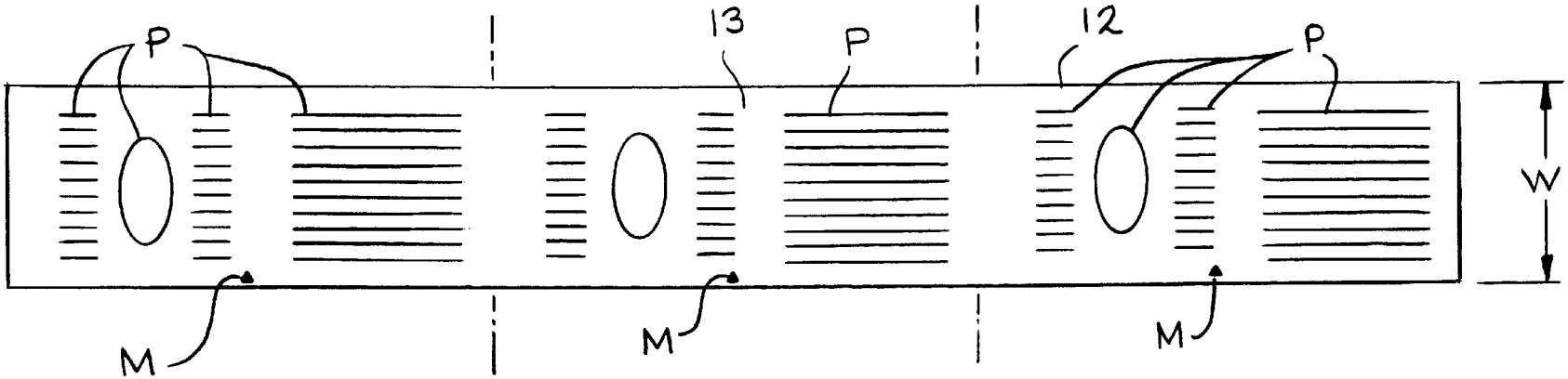
FIG. 6 is a view of a length of web of label material showing a series of repetitive patterns with a detectable mark in each pattern.
Figure 7:
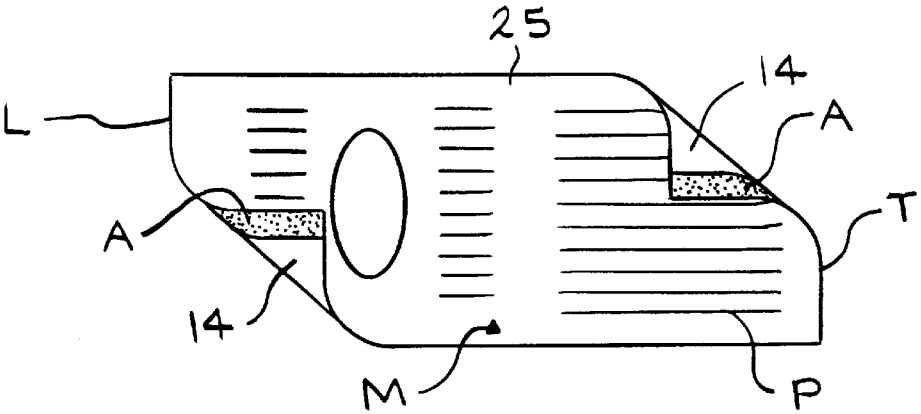
FIG. 7 is a view of a label showing the cut ends with corners turned over and adhesive adjacent each end on the side opposite the printed indicia.

Referring to FIGS. 6 and 7, there is shown in FIG. 6 a length of web 12 having indicia with repetitive patterns P printed on the first side 13, which includes a mark M on each label length which can be read by a scanner. FIG. 7 shows a label 25 extending from a leading end L to a trailing end T with indicia and a mark M on the first side 13. The label 25 in FIG. 7 is shown with one corner of each end turned to permit viewing the second side 14 and adhesive A extending completely to each end L and T. As will be seen from the following description, the web 12 will have had the adhesive A applied to the second side 14 prior to cutting. It is clear, therefore, that the adhesive A will extend completely to each of the leading end L and trailing end T.

The supply roll 10 is rotatable in a counter clockwise direction about a shaft 15 supported outwardly of a mounting frame 16. Following dispensing from the supply roll 10, the web 12 is fed through a label feed and print registration station 20, to a glue application assembly 30 and then to a vacuum drum 40 containing a plurality of knives 41 which cooperate with a heated anvil roller 42 to cut the web 12, with adhesive or glue newly applied thereto, into labels 25 of the desired length. The individual labels 25 are carried by the vacuum drum 40, with the adhesive facing outwardly, to a label application station 44 where each label 25 engages and is adhered to a container C moved into engagement therewith by a starwheel 45. The starwheel 45 successively carries the containers C to a position between the label 25 being carried on the vacuum drum 40 and a roll-on pad 46 which frictionally engages the containers C causing them to rotate as a result of being captured between the fixed roll-on pad 46 and the rotating vacuum drum 40. The rotating containers C contact the second side 14 of the individual labels 25 being carried by the rotating vacuum drum 40. With adhesive on the second side 14 of each label 25 adjacent each end L and T, the labels are thereby adhered to the containers C. As the containers approach the outlet end of the roll-on pad 46, they are moved onto a conveyor 50 and transported from the labeling apparatus.

The label feed and print registration station 20 includes a feed roller 21 which is driven by conventional power means and a brake 23 positioned to engage the feed roller 21 and the second side 14 of the web facing outwardly of the feed roller 21. The brake 23 is pivotally mounted on a post 24 for movement from a disengaged to an engaged position relative to the feed roller 21. An optical scanner 22 is mounted at a remote location to view the first side 13 of the web 12 and the mark M on each repetitive pattern P. As the web 12 leaves the supply roll 10, it passes over an idler roller 26, a dancer roller 27 secured to a pivotedly mounted dancer arm 28 and a second idler roller 29 before reaching the feed roller 21. The scanner 22 scans the printed first side 13 and the detects a specific mark M incorporated into the printed indicia on each repetitive pattern P. The scanner 22 upon detecting each mark M actuates the brake 23 to momentarily stop the feed roller 21 and the web 12. By stopping movement of the web 12 at the label feed station 20, the web 12 is caused to also be momentarily stopped in the area of the vacuum drum 40. The scanner 22 is synchronized in relation to the drum 40 and its cutters 41 so that the momentary stoppage of the web 12 occurs whenever the cutters 41 are aligned with the heated anvil roller 42 and thus cutting a label 25 from the web 12.

The vacuum drum 40 is power driven at a rate of speed such that its outer engagement surface engaged by the web 12 moves at the same speed as the normal speed of the web 12 when the brake 23 is not stopping movement of the web 12. As will be appreciated, the actuation of the brake 23 to stop movement of the web 12 while the vacuum drum 40 moves at a constant rotational speed, will result in the web 12 being momentarily stopped and sliding against the engagement surface of the vacuum drum 40. The slippage of the web 12 relative to the engagement surface of the vacuum drum 40 will obviously occur only in that area of the vacuum drum 40 on the upstream side from the area of engagement between the vacuum drum 40 and knives 41 engaging the heated anvil roller 42, i.e. that portion of the web 12 toward the glue applicator assembly 30 from the heated anvil roller 42. Such stoppage of the web 12 relative to the engagement surface of the vacuum drum 40 creates a space between the trailing end T of the previously cut label 25 and the end L of the oncoming web which will be the leading end L of the next label to be cut. By creating the space in this manner, it is possible, through the scanner 22 and brake 23 of the label feed system 20, to insure that each label 25 will have the desired length upon cutting and will have properly registered indicia. Labels of varying lengths can be cut using the same vacuum drum 40 with the same spacing between the knives 21 simply by using a web 12 having the marks M spaced at a different distance than from the previously utilized web 12. Thus, for example, using the same drum 40 and cutters 41, it is possible to produce some labels having a length, for example, of 9" and other labels having a length of 5", simply by replacing the supply roll 10 containing the web 12 with a new supply roll having a web with the marks M at a different spacing.

As will be appreciated, when the brake 23 is actuated, there will be a momentary stoppage in the movement of that portion of the web 12 between the brake 23 and the vacuum drum 40, but not a corresponding stoppage of movement of that portion of the web 12 between the feed roller 21 and the supply roll 10. In order to insure that tension is placed continually on the web 12 in the area between the feed roller 21 and supply roll 10, the dancer roller 27, mounted on the pivotedly mounted dancer arm 28, is moveable relative to the idler rollers 26 and 29 in order to take up any slack resulting from the momentary stoppage caused by the brake 23. A leather belt 17 passes around the supply roll 10 and engages the rolled web on the supply roll 10 to place some resistance to rotation of the supply roll 10 as is well known in the art. One end of the belt 17 is affixed to the frame 16 and the other end of the leather belt is affixed to a tension means, such as a spring which is itself affixed to the frame 16.

After leaving the label feed system 20, the web 12 passes around three idler rollers 31 before reaching the glue applicator assembly 30.

Referring specifically to FIGS. 1, 2, 4 and 5, the glue roller assembly 30 includes a hollow glue roller 32 mounted on a shaft 35 extending from a roller bearing housing 36 mounted on a support 43. The glue roller 32 has a knurled surface 33 and an internal heater 37 for maintaining the outer knurled surface 33 at substantially the same temperature as the glue, preferably a temperature in the range of 275 to 320° F. using a hot melt adhesive as the glue. An example of a suitable hot melt adhesive is one manufactured by National Adhesive of Bridgewater, N.J. and sold as its Easy Melt Item No. 34-5598.

Glue is delivered to the outer knurled surface 33 of the glue roller 32 by a glue bar 38 having an outlet slot 39. The glue bar 38 is supported on a mounting plate 61 and is yieldingly urged against the glue roller 32 by a pair of compression springs 62. Glue is pumped into the glue bar 38 through a hose and inlet passageway 34 which communicates with the outlet slot 39. In addition to delivering adhesive to the glue roller 32, the glue bar 38, which is manufactured of brass, functions to scrape excess glue from the knurled surface 33 prior to that portion of the glue roller 32 reaching the web portion intended to receive the glue. Excess glue wiped by the glue bar 38 is captured in the glue pan 51 which directs the excess glue to a glue return pipe 52 and hose 53 for conveyance to a recycling collector.

Figure 4:
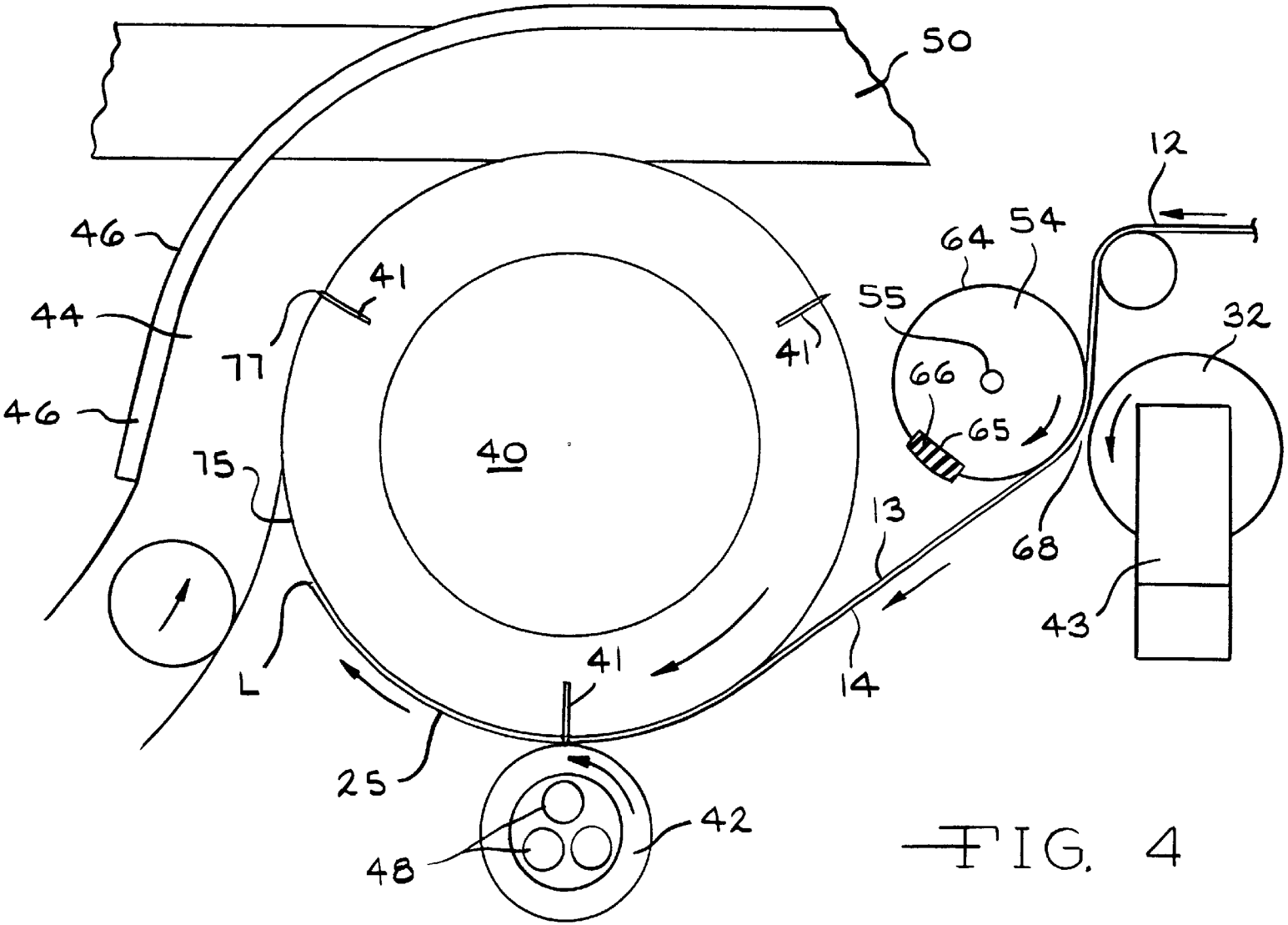
FIG. 4 is an enlarged top plan view showing the glue applicator, the. vacuum drum with its knives cutting a label and a container about to have a label applied thereto.
Figure 5:
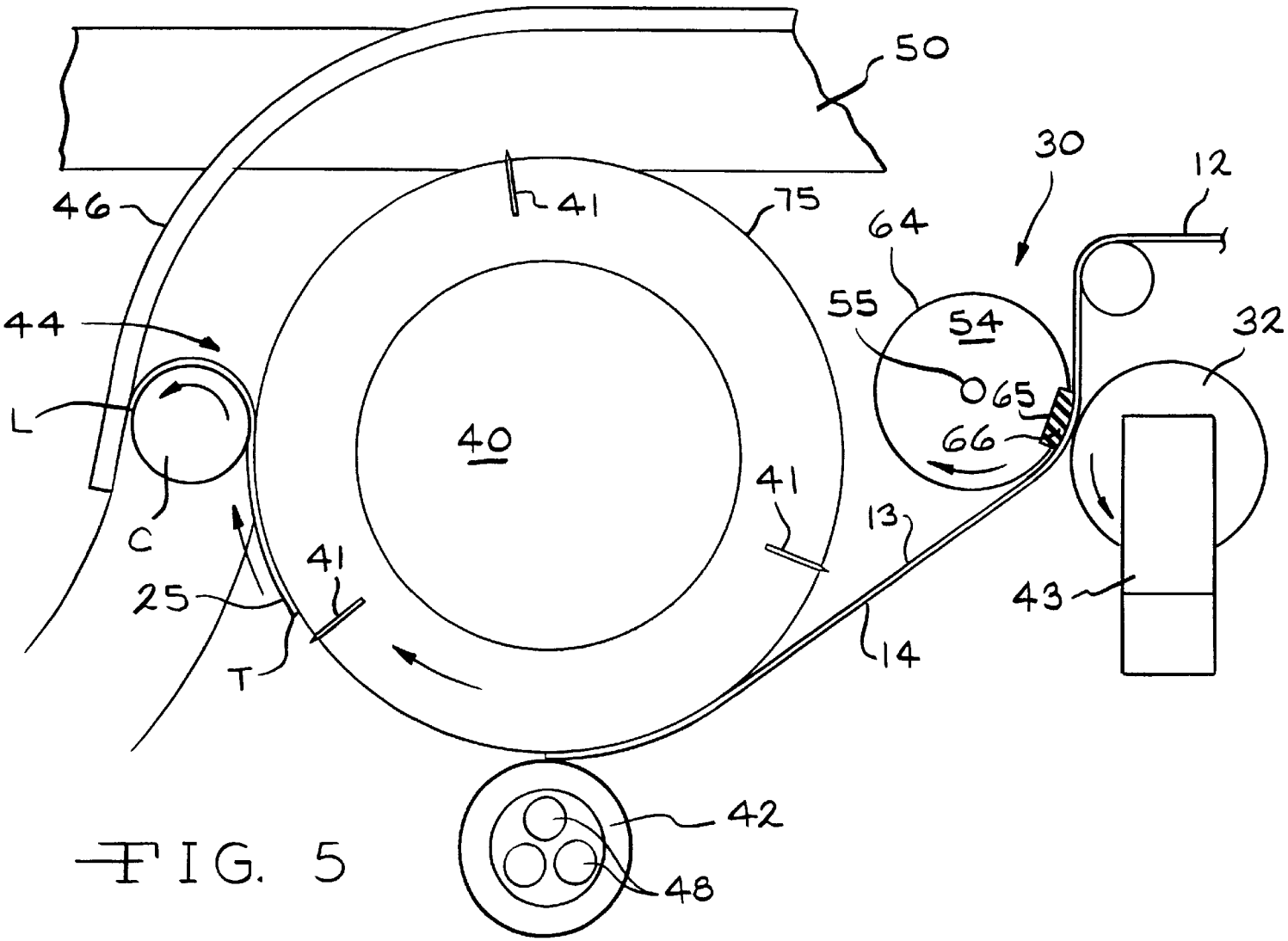
FIG. 5 is a view similar to FIG. 4 showing a label being applied to a container.

The glue applicator assembly 30 also includes a compression roller 54 mounted on a shaft 55 supported on a pressure arm 56 by a bearing 57 and a pair of collars 58. An air cylinder 59 is secured to the end of the pressure arm 56 opposite the bearing 57 and functions to move the compression roller 54 from a position spaced from the glue roller 32 as shown in FIG. 4 when no containers are being delivered for labeling to a position engaged to the glue roller 32 as shown in FIG. 5 when containers are being delivered to the vacuum drum 40. Both the glue roller 32 and the compression roller 54 are driven.

The compression roller 54 has a cylindrical surface 64 with an elongated recess 65 formed therein which is parallel to the axis of rotation of the compression roller 54. Positioned in the recess 65 is a rubber compression pad 66, the outer surface of which extends radially outwardly beyond the cylindrical outer surface 64 a distance on the order of 0.025". The length of the compression pad 66 and the height of the cylindrical outer surface 64 are slightly less than the width of the web 12 in order to avoid adhesive from inadvertently reaching the indicia on the first side 13.

As can be seen by viewing FIG. 4, at such times as the rubber compression pad 66 is out of alignment with the glue roller 32, there will be a slight gap 68 between the second side 14 of the web and the surface of the glue roller 32. As previously discussed, the operation of the scanner 22 and brake 23 upon being actuated by seeing the mark M is such as to momentarily stop the web 12 during the interval of cutting a label 25 from the web 12 when one of the knives 41 is aligned with the anvil 42. Since both the glue roller 32 and compression roller 54 are driven, the presence of the gap 68 during such momentary pauses in movement of the web 12 results in the web 12 sliding against the outer cylindrical surface 64 of the compression roller 54. Thus, it is important that the rotation of the compression roller 54 be so synchronized with the scanner 22 and brake 23 as to be out of engagement with the glue roller 32 during the interval of any stoppage of the web 12.

Figure 3:
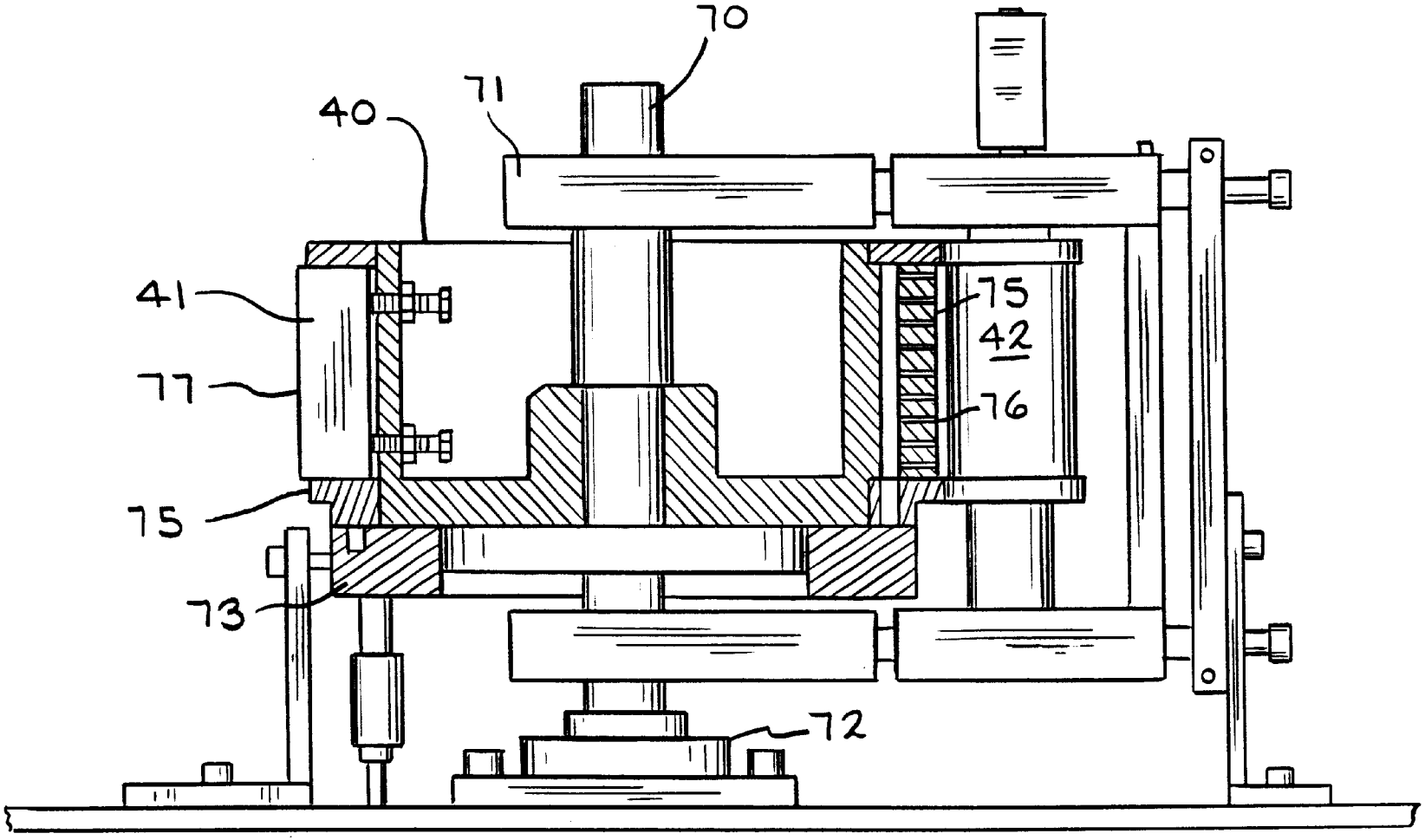
FIG. 3 is an enlarged elevational view of the vacuum drum of the labeling apparatus of FIG. 1.

Referring to FIG. 3, there is shown details of the vacuum drum 40 and the heated anvil drum 42. The vacuum drum 40 is mounted for rotation on a central post 70 extending through an upper bearing housing 71 and supported in a lower bearing assembly 72.

The drum 40 has an outer engagement surface 75 for engagement of the first side 13 of the web 12 and, following cutting, engagement of the newly cut label 25. A plurality of passageways 76 extend from the engagement surface 75 and communicate with a vacuum valve 73.

A plurality of knives 41, preferably 3 in number, are mounted on the vacuum drum 40 and have cutting edges 77 which extend radially outwardly beyond the engagement surface 75 a distance sufficient to cut through the web 12 to form the labels 25.

The heated anvil roller 42 may be heated by a plurality of cartridge heaters 48 and is mounted for rotation in spaced parallel relationship with the engagement surface 75 of the vacuum drum 40 in a position to be engaged by the cutting edge 77 of each knife 41 as it encounters the anvil roller 42 with the web 12 therebetween on each rotational cycle to thereby sever a label 25 from the web 12.

The vacuum valve 73 is operable to apply vacuum through the passageways 76 during those portions of the rotational cycle when the web 12 initially engages the vacuum drum 40 as it arrives from the glue application assembly 30 and to continue applying such vacuum to retain the labels 25 on the engagement surface 75 until such time as the label engages a container C at the label application position 44 at which point the vacuum will cease. A description of applying vacuum, positive pressure, or neither a vacuum nor a positive pressure during certain rotational cycles is provided in my prior U.S. patent application Ser. No. 09/024,886 filed Feb. 17, 1998. If desired, the vacuum drum 40 and/or the knives 41 may be heated.

Figure 8:
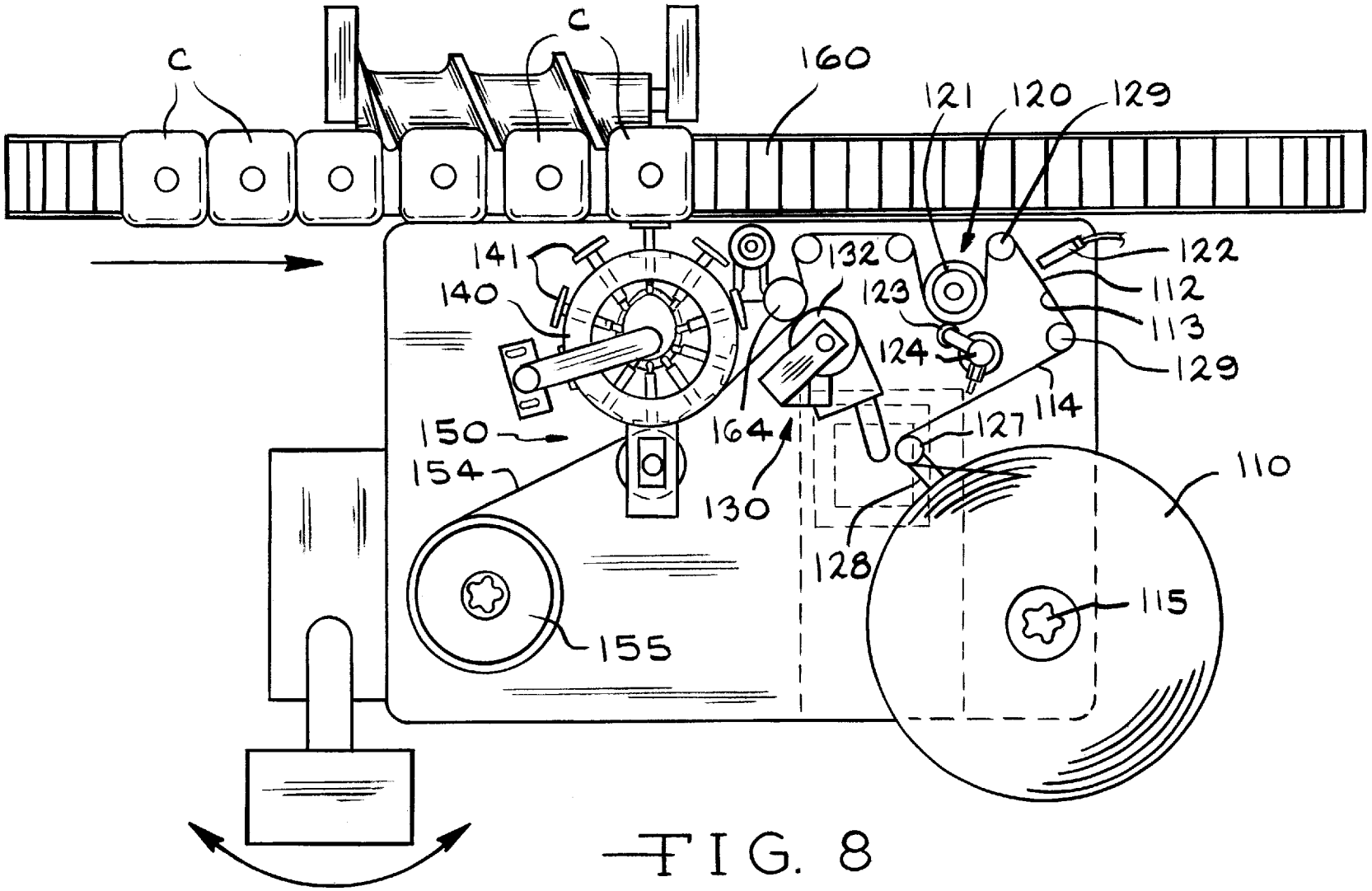
FIG. 8 is a schematic top plan view of another embodiment of the present invention.
Figure 9:
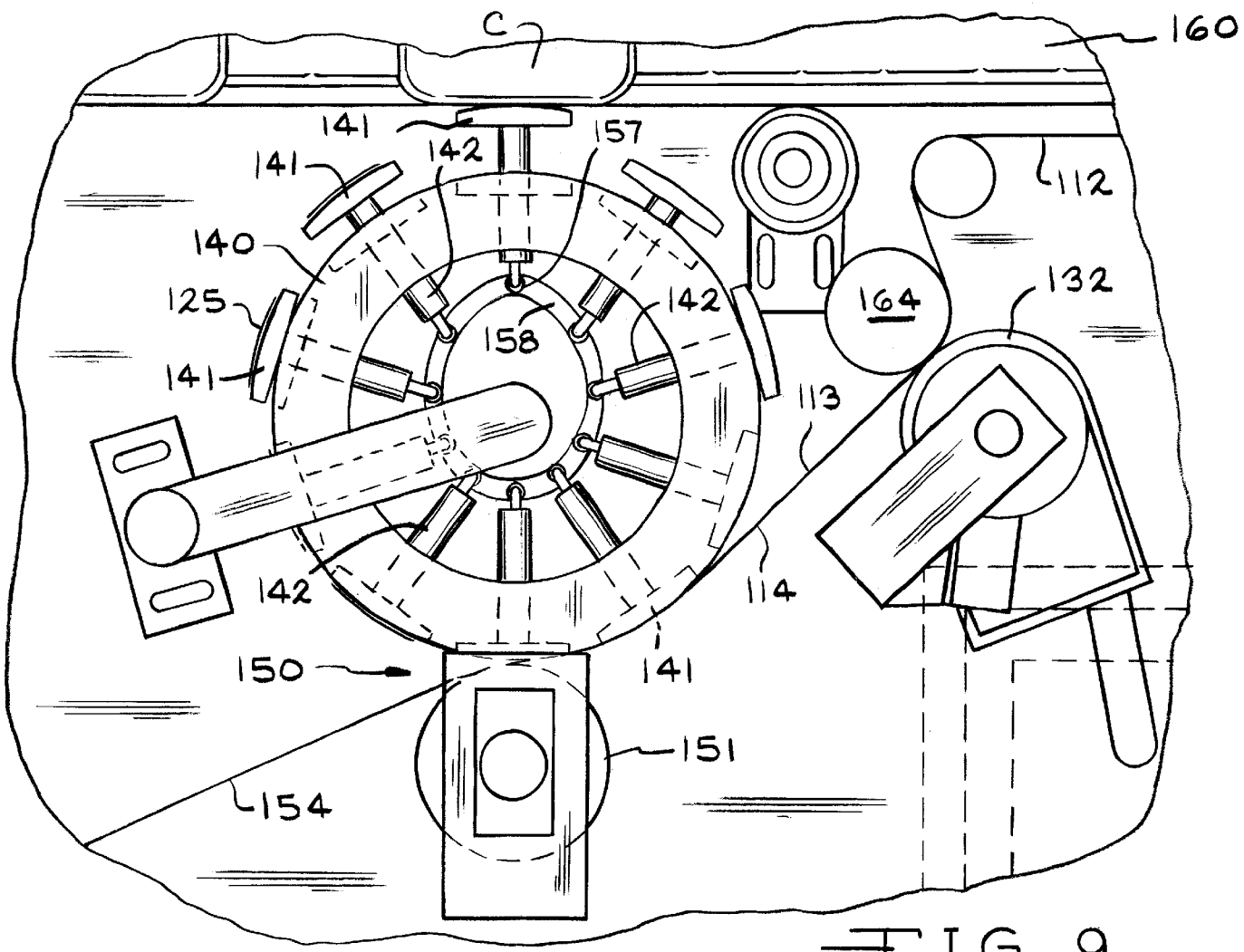
FIG. 9 is an enlarged view of a portion of the embodiment shown in FIG. 8.
Figure 10:
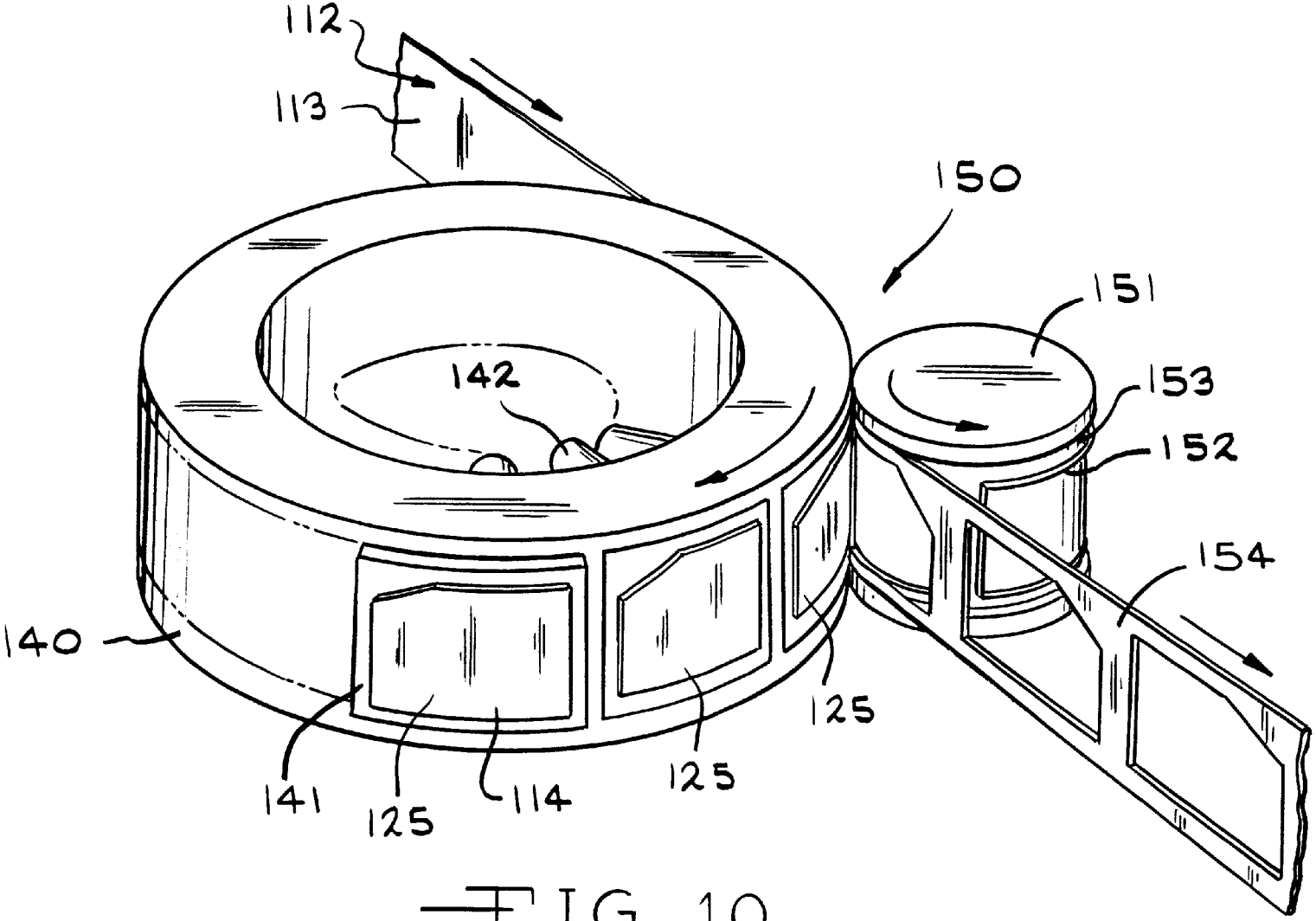
FIG. 10 is a perspective view showing labels being cut from the web and showing the skeletal remnant of the web removed from the cut labels.

Referring to FIGS. 8 through 10, there is shown a second embodiment of the present invention. Under this embodiment, there is provided a supply roll 110 containing a web 112 of label stock having a first side 113 with printed indicia and a second side 114 which is intended to receive adhesive for adhering a label cut from said web 112 to a container. The supply roll 110 is rotatable in a counterclockwise direction on a shaft 115 mounted on the label roll mounting frame.

Following dispensing from the supply roll 110, the web 112 is fed through a label feed station 120, to a glue application assembly 130 and then to a rotary back up and transfer drum 140 containing a plurality of vacuum applicator plates 141 which receive labels 125 cut from the web 112 by knives 152 on a heated roller 151.

The label feed station 120 includes a feed roller 121 which is driven by conventional power means and a brake 123 positioned to engage the feed roller 121 and the second side 114 of the web 112 facing outwardly of the feed roller 121. The brake 123 is pivotally mounted on a post 124 for movement from a disengaged to an engaged position relative to the feed roller 121. An optical scanner 122 is mounted at a remote location to view the first side 113 of the web 112 and a mark on each repetitive pattern. As the web 112 leaves the supply roll 110, it passes over a dancer roller 127 secured to a pivotedly mounted dancer arm 128 and a pair of idler rollers 129 before reaching the scanner and the feed roller 121. The scanner 122 scans the printed first side 113 and the detects a specific mark incorporated into the printed indicia on each repetitive pattern. The scanner 122 operatively controls a differential transmission connected to the feed roller 121 and, upon detecting each mark, momentarily speeds up or slows down the feed roller 121 and speed of movement of the web 112 in order to insure proper registration of the indicia with the cutters or knives 152. In contrast to the embodiment of FIGS. 1–7 in which the web 12 is momentarily stopped at the instant of cutting, under the present embodiment, the web 112 moves continuously through the label feed station 120, glue application assembly 130 and rotary back-up and transfer drum 140. Although as stated above, its movement may be momentarily speeded or slowed to insure proper registration with the cutters or knives 152, its movement is continuous.

The glue application assembly 130 is similar to that described in reference to the embodiment of FIGS. 1–7 with one notable exception. Under the embodiment of FIGS. 8–10, since the label 125 is being die cut to a shape that may be a non-rectangular shape thereby leaving a skeletal web 154, it is desirable that the entire second surface 114 be covered with adhesive. Accordingly, the compression roller 164 shown in FIG. 8 has a cylindrical surface which continuously urges the web 112 against the glue roller 132.

The web 112 with glue applied to the entire second surface 114 then moves to the rotatable drum 140 with its vacuum applicator plates 141. Each of the vacuum applicator plates 141 is mounted on a cam actuated shaft 142 for movement from a retracted position at which individual labels 125 may be cut from the web 112 to an extended position for affixing each label 125 to a container C. As the drum rotates, a cam follower 157 associated with each shaft 142 moves in a groove 158 of a cam member to control the extent of radial movement of each shaft 142 and its associated vacuum applicator plate 141.

The degree of extension of each vacuum applicator plate 141 from the surface of drum 140 provides means for changing and adjusting the pitch distance between the labels 125 as die cut from the web 112 for matching the pitch of the oncoming containers C to be labeled.

Shortly following engagement of the web 112 to the rotating drum 140 and the vacuum applicator plates 141, the web 112 is carried to the cutting station 150 where individual labels 125 are cut. The cutting station 150 includes a rotatable roller 151 having mounted thereon a plurality of knives 152 which are shaped to die cut individual labels 125 to a specific shape from the web 112 to leave a skeletal web 154 which is wound on a waste collection roll 155. The knives 152 mounted on the rotatable roller 151 are positioned relative to the vacuum applicator plates 141 of the rotatable drum 140 to successively cut a label 125 from the web 112 while the knife 152 die cutting such label is aligned with a vacuum applicator plate 141. The vacuum applicator plate 141, during the period of alignment with the knife 152, also functions as an anvil against which the web 112 is captured between it and the knife 152 to facilitate cutting. The roller 151 has a plurality of knives 152, preferably four, equally spaced around the roller 151 and extending outwardly a short distance, approximately ⅛ inch from its cylindrical outer surface 153. The portions of the roller 151 lying within each closed shape defined by each of the knives 152 is recessed at least ¼ inch from the cutting edge of each knife in order to prevent excessive heat from the roller 151 reaching the web 112 and the labels 125 being die cut therefrom. The roller 151 and knives 152 may be heated to minimize the possibility of glue sticking to the knives 152 as a result of die cutting the web 112 through the newly applied adhesive.

Instead of or in addition to heating the roller 151, a silicone spray may be directed to each of the knives 152 immediately prior to the knives 152 reaching the area of engagement with the web 112 and cutting a label therefrom in order to minimize glue sticking to the knives 152. Following removal of the skeletal web 154, each individual label 125 is supported on the vacuum applicator plate 141 with the adhesive on the second side 114 facing outwardly. In contrast to the embodiment of FIGS. 1–7 in which the web 12 is momentarily stopped during cutting, under the present embodiment, the web 112 moves continuously.

As an applicator plate 141 carrying a label 125 rotating on the rotatable drum 140 approaches the ten o'clock position in its rotation as shown in FIG. 9, it is cammed radially outwardly to an extended position such that it will engage a container C passing thereby on a conveyor 160 at the twelve o'clock position shown in FIG. 9. Upon engagement of the label 125 with the container C, the vacuum is released from the vacuum applicator plates 141 and the container C with the label 125 adhered thereto continues its movement on the conveyor 160 to the next processing station.

A major advantage of the present embodiment of FIGS. 8–10 is that the labels are directly transferred from the rotary vacuum drum on which they are die cut from the web to a container. This in contrast to convention labeling machine which require that the labels (as opposed to the web of label material) are moved onto separate rotatable drums prior to reaching a container intended to be labeled. This feature permits the embodiment of FIGS. 8–10 to have higher line speeds than is possible with conventional machines.

Many modifications will be readily apparent to those skilled in the art. For example, if desired, the adhesive could be sprayed on to the web 12 or 112. My prior application Ser. No. 09/024,886 filed Feb. 17, 1998 discloses a spray and catcher system for recycling adhesive. Additionally, other types of cutting devices known in the industry could be used for cutting the labels from the web with adhesive applied thereto. Examples of such alternate cutting devices include a modified steel rule type die and laser cutting. Accordingly, the scope of the present application should be determined only by the scope of the claims.

I claim:

1. A method for applying labels to articles comprising the steps of (a) feeding a web of label material from a supply reel, said label material having a first side and a second side, said first side having printed indicia defining a repetitive pattern having a mark;

(b) providing (i) a vacuum drum rotating at a constant number of revolutions per minute and (ii) a second drum operating at a constant number of revolutions per minute, one of said drums having one or more knives and the other of said drums functioning as an anvil;

(c) applying adhesive to said second side;

(d) engaging said web to said vacuum drum and moving said web between said vacuum drum and said second drum to successively cut said web into labels, said cuts being made through both said web and newly applied adhesive;

(e) sensing each said mark prior to said mark reaching said vacuum drum;

(f) causing a variation in speed of movement of a length of said web containing the sensed mark prior to the repetitive pattern containing such mark reaching the area of engagement between said knives and said anvil to cause said web to slip relative to said vacuum drum; and (g) carrying said labels on said vacuum drum into engagement with said articles.

2. The method according to claim 1 wherein one of said drums is heated.

3. The method according to claim 1 wherein means are provided to prevent or minimize adhesive from sticking to said knives.

4. The method according to claim 3 wherein a lubricant is applied to said knives.

5. The method according to claim 1 wherein said labels carried by said vacuum drum successively moved into engagement with said articles.

6. A method for applying labels to articles comprising the steps of (a) feeding a web of label material from a supply reel, said label material having a first side and a second side, said first side having printed indicia;

(b) providing (i) a rotating vacuum drum and (ii) a second drum, one of said drums having one or more knives;

(c) applying adhesive to at least a portion of said second side;

(d) immediately thereafter engaging said web to said vacuum drum and moving said web between said vacuum drum and said second drum to successively cut through said adhesive and said web to form labels, said cutting being made while said adhesive is in a condition to affix said labels to said articles; and (e) carrying said labels on said vacuum drum and into engagement with said articles.

7. The method according to claim 6 further including the step of applying heat to one of said vacuum drum or said second drum.

8. The method according to claim 6 further including the step of (i) applying a chemical to said knives or (ii) heating said knives to prevent or minimize adhesive from sticking to said knives.

9. The method according to claim 8 wherein said chemical applied to said knives is a lubricant.

10. The method according to claim 6 wherein said vacuum drum is provided with knives and said second drum functions as an anvil.

11. The method according to claim 6 wherein said vacuum drum is provided with a plurality of vacuum applicator plates, and further including the step of moving said applicator plates in a radial direction from a retracted position when aligned with said second drum to an extended position for engagement with said articles.

12. The method according to claim 11 wherein said second drum is provided with knives.

13. The method of claim 11 wherein each said knife defines a closed shape for die cutting a label conforming to said shape.

14. The method of claim 11 further including the step of heating said second drum, said second drum being provided with one or more knives with edges which define a closed shape for die cutting a label conforming to said shape, the area of said second drum within said closed shape being recessed from said edges to avoid the transfer of excessive heat to said labels during the step of die cutting.

15. The according to claim 11 further including the steps of (i) providing, on said second drum, one or more knives which define a closed shape, said knives extending to a tip outwardly from an outer surface of said second drum, those portions of said outer surface positioned outwardly of said closed shape being spaced radially inwardly of said tip and those portions of said second drum lying within said closed shape being spaced radially inwardly from said tip a greater distance than said outer surface portions outwardly of said closed shape, (ii) heating said second drum and (iii) die cutting a label from said web.

16. A method for labeling containers comprising the steps of (a) feeding a web of label material from a supply reel, said label material having a first side and a second side, said first side having printed indicia;

(b) providing (i) a rotating drum, said rotating drum having a circumferential outer wall and a plurality of vacuum applicator plates, said vacuum applicator plates having a label engagement surface and being mounted for (1) rotation with said drum and (2) movement radially from a retracted position at which said label engagement surface is generally aligned with said outer wall to an extended position outwardly from said outer wall, and (ii) a second drum having knives positioned for operable engagement with said vacuum applicator plates and said web;

(c) applying adhesive to said second side;

(d) immediately thereafter moving said web between said rotating drum and said second drum to successively cut through said web and adhesive to form labels;

(e) supporting each label on a vacuum applicator plate;

(f) extending each of said vacuum applicator plates with a label supported thereon; and (g) affixing said labels to containers.

17. The method according to claim 16 further including the step of varying the outward distance of said vacuum plates from said outer wall when in the extended position and engaging a label to a container.

18. The method of claim 16 wherein each said knife defines a closed shape for die cutting a label conforming to said shape.

19. The method of claim 16 further including the step of heating said second drum, said second drum being provided with one or more knives with edges which define a closed shape for die cutting a label to shape, the area of said second drum within said closed shape being recessed from said edges to avoid the transfer of excessive heat to said labels during the step of die cutting.

20. A method for preparing labels with adhesive within an apparatus for application to containers comprising the steps of (a) feeding a web of label material from a supply reel of the apparatus, said label material having a first side and a second side;

(b) providing a vacuum drum rotating at a constant number of revolutions per minute and a second drum operating at a constant number of revolutions per minute, one of said drums having one or more knives and the other of said drums functioning as an anvil;

(c) engaging said web to one of said drums and moving said web between said one drum and the other of said drums to successively cut said web into labels;

(d) causing a variation in speed of movement of a length of said web, prior to engagement of said web between knives and said anvil, wherein further said first side of said label material is provided with printed indicia defining a repetitive pattern having a mark, each said mark being sensed by a scanner prior to said mark reaching said vacuum drum, the variation in speed being caused by the scanner concerning a length of said web containing the sensed mark prior to the repetitive pattern containing such mark reaching the area of engagement between said knives and said anvil, wherein the web, following dispensing from the supply roll is fed through a label feed and print registration station, characterized in that the web is then further fed to a glue application assembly, wherein adhesive is applied to said second side of said web prior to engaging said web to said vacuum drum and cutting is performed through the newly applied adhesive as well as the web such that each label has adhesive completely to each end thereof, whereby each newly cut label, supported on the said vacuum drum, successively engages a container while its adhesive is in condition for adhering to the container.

21. The method according to claim 20, wherein said label feed and print registration station includes a feed roller and further characterized in that the scanner operatively controls a transmission connected to the feed roller to momentarily speed up or slow down the feed roller and thereby the speed of movement of the web.

22. The method according to claim 20, characterized in that a brake is provided and further including the step of momentarily stopping the movement of the web and causing slippage of said web relative to said vacuum drum.

23. The method according to claim 22, characterized in that the glue application assembly includes a compression roller and a glue roller and further including the step of moving said compression roller from a position spaced from said glue roller to a position engaged to said glue roller and further including the step of synchronizing rotation of said compression roller with said scanner to move said compression roller out of engagement with said glue roller during the interval of stoppage of said web to provide relative movement between said compression roller and said web.

24. The method according to claim 23 further including the step of synchronizing rotation of said compression roller with said scanner to move said compression roller out of engagement with said glue roller during the interval of stoppage of said web.

25. The method according to claim 20 further including the step of heating one of said drums.

26. The method according to claim 20 further including the step of preventing or minimizing adhesive sticking to said knives.

27. The method according to claim 26 further including the step of applying a lubricant to said knives.

28. The method according to claim 20 further including the step of successively moving labels carried by said vacuum drum into engagement with said containers.

29. The method according to claims 20 further including the step of providing said vacuum drum with a plurality of radially movable vacuum applicator plates and further including the step of moving said applicator plates from a retracted position when aligned with said second drum to an extended position for engagement with said containers.

30. The method according to claim 20 wherein each of said knife defines a closed shape and further including the step of cutting a label conforming to said closed shape.

31. The method according to claim 20 wherein each said knife defines a closed shape on said second drum and the area of said second drum within said closed shape is recessed from said edges and further including the step of cutting a label conforming to said closed shape while preventing the transfer of excessive heat to said labels during the step of die cutting.

32. A method for applying labels to articles comprising the steps of (a) feeding a web of material from a supply, said web having a first side and a second side, (b) applying adhesive directly to one of said sides, (c) successively cutting said web immediately following the application of said adhesive to form labels, and (d) applying labels to articles immediately following said step of cutting while said adhesive is in condition to adhere said labels to said articles.

* * * * *